US008387788B2

(12) United States Patent
Nakano et al.

(10) Patent No.: US 8,387,788 B2
(45) Date of Patent: Mar. 5, 2013

(54) CIGARETTE PACKAGE

(75) Inventors: Keiko Nakano, Tokyo (JP); Akira Miyazawa, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 12/834,644

(22) Filed: Jul. 12, 2010

(65) Prior Publication Data

US 2010/0276313 A1 Nov. 4, 2010

Related U.S. Application Data

(63) Continuation of application No. PCT/JP2009/050221, filed on Jan. 9, 2009.

(30) Foreign Application Priority Data

Jan. 18, 2008 (JP) ..... 2008-009200

(51) Int. Cl.
*A24F 15/00* (2006.01)
*B65D 85/10* (2006.01)
*B65D 85/12* (2006.01)

(52) U.S. Cl. ..... 206/268; 206/273; 206/818; 229/160.1

(58) Field of Classification Search ..... 206/242–276, 206/818; 229/160.1; 220/230
See application file for complete search history.

(56) References Cited

U.S. PATENT DOCUMENTS

| | | | | | |
|---|---|---|---|---|---|
| 3,749,301 | A * | 7/1973 | Peckar | 229/125.37 |
| 4,823,943 | A * | 4/1989 | Chang | 206/5 |
| 4,948,038 | A * | 8/1990 | Moeller | 229/146 |
| 5,511,658 | A * | 4/1996 | Focke et al. | 206/271 |
| 5,833,060 | A * | 11/1998 | Draghetti et al. | 206/268 |
| 6,105,856 | A | 8/2000 | Kakiuchi | |
| 6,199,687 | B1 | 3/2001 | Tambo et al. | |
| 7,832,438 | B2 * | 11/2010 | Cameron | 150/160 |

FOREIGN PATENT DOCUMENTS

| | | | |
|---|---|---|---|
| CN | 1149545 | A | 5/1997 |
| CN | 1206384 | A | 1/1999 |
| CN | 1208007 | A | 2/1999 |
| CN | 1738553 | A | 2/2006 |
| EP | 0 392 737 | A1 | 10/1990 |
| EP | 0 764 595 | A1 | 3/1997 |
| EP | 0 895 940 | A2 | 2/1999 |
| EP | 1 801 032 | A1 | 6/2007 |
| FR | 1529783 | A1 | 6/1968 |
| JP | 2-296641 | A | 12/1990 |
| JP | 7-149343 | A | 6/1995 |
| JP | 11-49134 | A | 2/1999 |
| RU | 2294308 | C2 | 2/2007 |
| WO | WO 2005/007538 | A1 | 1/2005 |

* cited by examiner

*Primary Examiner* — Mickey Yu
*Assistant Examiner* — Chun Cheung
(74) *Attorney, Agent, or Firm* — Birch, Stewart, Kolasch & Birch, LLP

(57) ABSTRACT

A cigarette package of the invention has a casing (10), which includes an open end (12) that is opened/closed with a tongue lid (16). The tongue lid (16) has a lid portion (18), a tongue portion (22), and a magnet (28) fixed onto the tongue portion (22). A sheet (34) capable of being attracted to the magnet (28) is fixed onto a front wall (10*f*) of the casing (10). When the tongue lid (16) is in the closed position, the magnet (28) and the sheet (34) keep the tongue portion (22) attracted to the front wall (10*f*) in cooperation with each other by using the attracting force of the magnet (28). At the time of closing the tongue lid (16), the tongue portion (22) hits the front wall (10*f*) and thus makes a clap sound.

16 Claims, 5 Drawing Sheets

CIGARETTE PACKAGE

CROSS REFERENCE TO RELATED APPLICATIONS

This application is a Continuation of PCT International Application No. PCT/JP2009/050221 filed on Jan. 9, 2009 which claims the benefit of Patent Application No. 2008-009200 filed in Japan on Jan. 18, 2008. The entire contents of all of the above applications are hereby incorporated by reference into the present application.

TECHNICAL FIELD

The present invention relates to a cigarette package for containing rod-shaped cigarette products, such as filter cigarettes and cigarettes.

BACKGROUND ART

In general, a hinge-lid package has been widely used as a cigarette package of the above-mentioned type. However, as the hinge-lid package has been used for long, the shape of the hinge-lid package is not new to consumers. Under this circumstance, a tongue-lid package has been developed as a package with a new shape to replace the hinge-lid package (see Patent Document 1, for example).

The tongue-lid package shown in Patent Document 1 has a greatly different appearance from ordinary hinge-lid packages, and is therefore considered to enhance buying motivations. [Patent Document 1] International Publication No. WO2005/007538

DISCLOSURE OF THE INVENTION

Problems to be Solved by the Invention

A tongue-lid package disclosed in Patent Document 1 includes a casing with an open end and a tongue lid for opening/closing the open end of the casing. When the tongue lid is in a closed position, the tongue lid has a lid portion closing the open end of the casing and a tongue portion overlapped with a front wall of the casing. The tongue lid is kept in the closed position while a tip end of the tongue portion is inserted in a slit formed in the front wall.

The opening and closing of the above-mentioned tongue lid require actions including the pulling-up and insertion of the tongue portion from and into the slit, and make it difficult to open and close the tongue lid.

It is an object of the invention to provide a cigarette package, a tongue lid of which is easy to open and close, and a user can easily verify that the tongue lid is securely closed.

Means for Solving the Problems

In order to accomplish the above object, the cigarette package of the invention comprises a casing with an open end; a tongue lid connected to a rear edge of the open end of the casing through a first self hinge, the tongue lid including a lid portion for opening/closing the open end, and a tongue portion connected to the lid portion through a second self hinge and overlapped with a front wall of the casing when the tongue lid is in a closed position; and a sound-producing/holding device for making a clap sound indicating that the tongue lid is brought into the closed position at the time of closing the tongue lid, and holding the tongue lid in the closed position.

More specifically, the sound-producing/holding device includes a magnet fixed onto an inner surface of either one of the front wall and the tongue portion, and a sheet member fixed onto an inner surface of the other one of the front wall and the tongue portion and capable of being attracted to the magnet. When the tongue lid is in the closed position, the front wall is sandwiched between the magnet and the sheet member.

According to the above-mentioned cigarette package, when the tongue lid is in the closed position, the tongue portion of the tongue lid, which is overlapped with the front wall of the casing, is stuck to the front wall due to a magnetic force of the magnet, which acts on the sheet member. The tongue lid is thus stably maintained in the close position. When the tongue lid in the closed position is detached from the front wall against the attracting force, the tongue lid is allowed to be opened.

At the time of closing the tongue lid, the tongue portion hits the front wall of the casing due to the attracting force, and makes a clap sound. This clap sound assures the user that the tongue lid is closed.

Preferably, the magnet is fixed onto an inner surface of a tip end portion of the tongue portion, and the sheet member is fixed onto the inner surface of the front wall.

The sound-producing/holding device may further include a striking flap fixed onto an inner surface of the tongue and covering the magnet. The striking flap makes the tongue portion heavier, and thus contributes to the production of a clear clap sound at the time of closing the tongue lid.

The sound-producing/holding device may further include a notch formed in a front edge of the open end. When the tongue lid is in the closed position, the notch is covered with the tongue portion. In this case, the sheet member is preferably located near the notch. The notch provides the front wall with an opening for accessing products, such as filter cigarettes and cigarettes. The presence of the notch and the location of the sheet member forms the front wall as a sounding board, and improve the quality of the clap sound.

First and second self hinges have an arc-shaped cross-section when the tongue lid is in the closed position. The first and second self hinges facilitate the closing of the tongue lid. At the time of closing the tongue lid, the tongue portion hits the front wall of the casing without fail with the entire inner surface thereof.

The cigarette package of the invention may further include foldable gussets connecting side edges of the lid portion to side walls of the casing. These gussets are in a folded position and sandwiched between the open end of the casing and the lid portion when the tongue lid is in the closed position. When the tongue lid is opened, the gussets form partition walls between the side walls of the casing and the lid portion.

Advantages of the Invention

According to the cigarette package of the invention, when the tongue lid is in the closed position, the tongue portion overlapped with the front wall of the casing is held by the front wall because of the function of the sound-producing/holding device. This makes it easy to open/close the tongue lid. At the time of closing the tongue lid, the sound-producing/holding device makes a clap sound, so that the user can positively verify that the tongue lid is closed.

REFERENCE MARKS

Figure 1:
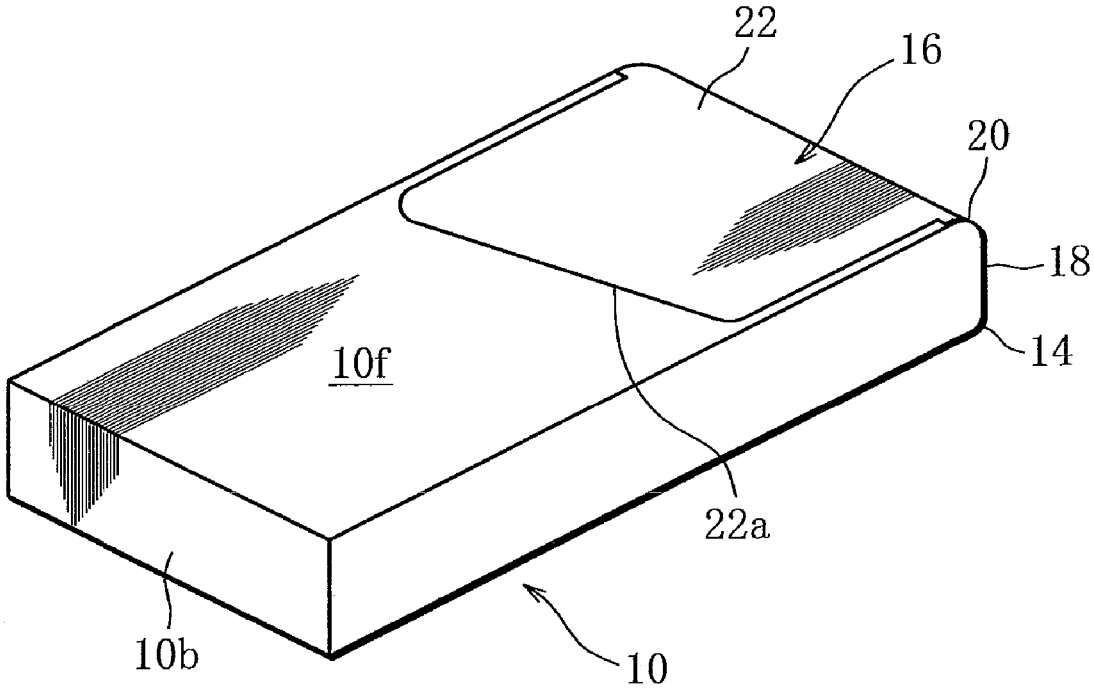
FIG. 1 is a perspective view showing a cigarette package of a first embodiment with a tongue lid in a closed position.

10 Casing
10*f* Front wall
12 Open end
16 Tongue lid
18 Lid portion
22 Tongue portion
24 Notch
26 Striking flap
28 Magnet
34 Sheet

BEST MODE FOR CARRYING OUT THE INVENTION

Figure 2:
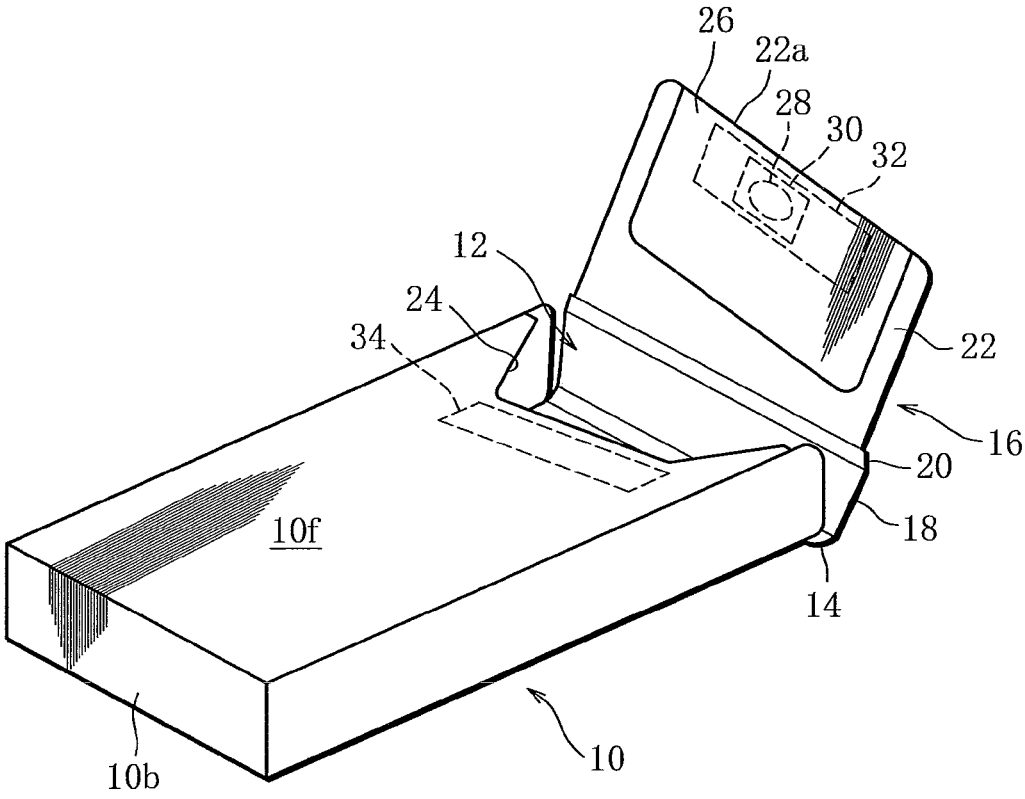
FIG. 2 is a perspective view showing the cigarette package of FIG. 1 with the tongue lid in an open position.

FIGS. 1 and 2 show a cigarette package of a first embodiment.

The cigarette package of FIG. 1 includes a casing 10 having a shape of a rectangular parallelepiped. One end, namely, an upper end, of the casing 10 is formed into an open end 12. An inner pack (not shown) is contained in the casing 10. The inner pack includes a bundle of twenty filter cigarettes and an inner wrapper enclosing the bundle.

A tongue lid 16 is connected to a rear edge of the open end 12 of the casing 10 through a first self hinge 14. The tongue lid 16 includes a lid portion 18 for opening/closing the open end 12 and a tongue portion 22 connected to the lid portion 18 through a second self hinge 20.

According to the present embodiment, each of the first and second self hinges 14 and 20 is formed of a group of fold lines extending parallel to one another. For this reason, when the tongue lid 16 is in a closed position as shown in FIG. 1, the first and second self hinges 14 and 20 form front and rear edges of the lid portion 18 into rounded edges. Each of the edges has an arc-shaped cross-section.

When the tongue lid 16 is in the closed position, the tongue portion 22 is overlapped with a front wall 10*f* of the casing 10 and covers a substantially U-shaped notch 24 of the front wall 10*f*. The notch 24 is formed in an upper edge of the front wall 10*f* and connected with the open end 12. When the tongue lid 16 is opened as illustrated in FIG. 2, therefore, the notch 24 provides an opening for accessing the casing 10 in cooperation with the open end 12. This access opening facilitates the removal of a filter cigarette from the casing 10.

To be more specific, a front edge 22*a* of the tongue portion 22 is not parallel to but inclined in relation to the lid portion 18. The notch 24 has a shape like a deformed U along with the inclination of the front edge 22*a*.

As illustrated in FIG. 2, the tongue portion 22 has a striking flap 26 located on the inner surface thereof. The striking flap 26 extends from the front edge 22*a* of the tongue portion 22 to overlap with the inner surface of the tongue portion 22, and is bonded to the tongue portion 22. The striking flap 26 also functions as a lining reinforcing the tongue portion 22.

Moreover, the striking flap 26 has, for example, a circular flat magnet 28. The magnet 28 is sandwiched between the striking flap 26 and the inner surface of the tongue portion 22, and is located near the front edge 22*a* of the tongue portion 22. More specifically, the magnet 28 is in contact with the inner surface of the tongue portion 22 with a sheet-like mount 30 intervening therebetween. The magnet 28 is covered with a double-sided adhesive tape 32 together with the mount 30. The double-sided adhesive tape 32 thus sticks to both an inner surface of the striking flap 26 and the inner surface of the tongue portion 22, thereby holding the magnet 28 and the mount 30 between the tongue portion 22 and the striking flap 26.

A sheet 34 is affixed to an inner surface of the front wall 10*f* of the casing 10. This sheet is made of material that can be attracted by the magnet 28, and is located adjacently to a bottom of the notch 24.

Figure 3:
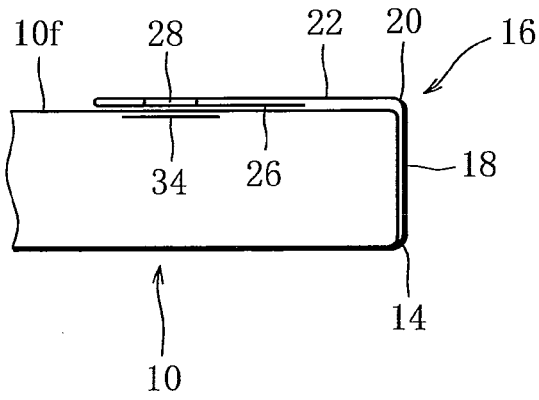
FIG. 3 shows the arrangement of a magnet and a sheet when the tongue lid is in the closed position.

When the tongue lid 16 is in the closed position, that is, when the tongue portion 22 is overlapped with the front wall 10*f*, the magnet 28 of the tongue portion 22 is superimposed upon the sheet 34 with the striking flap 26 and the front wall 10*f* sandwiched between the magnet 28 and the sheet 34 as illustrated in FIG. 3. Therefore, the magnetic force of the magnet 28 attracts the sheet 34, the magnet 28 is relatively pulled to the sheet 34.

Figure 4:
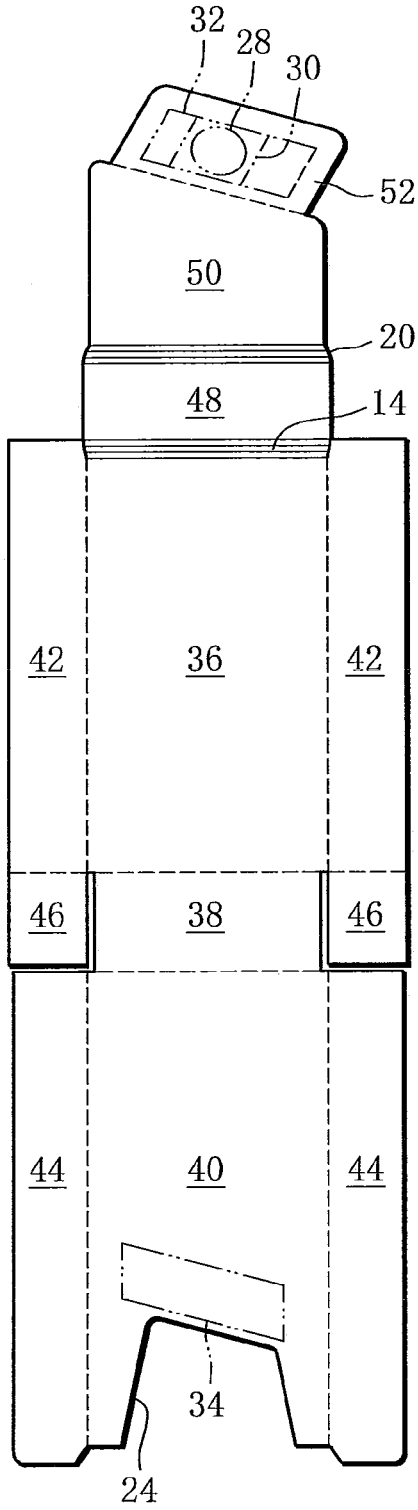
FIG. 4 shows a blank for fabricating the cigarette package of FIGS. 1 and 2.

FIG. 4 shows a blank for fabricating the above-mentioned cigarette package. The blank includes a plurality of panels and flaps. More specifically, the blank includes a rear panel 36, a bottom panel 38, and a front panel 40 with the notch 24. These panels 36, 38 and 40 form a rear wall, a bottom wall 10*b* and the front wall 10*f*, respectively, of the casing 10. Inner side flaps 42 are connected to both side edges of the rear panel 36 through fold lines. Outer side flaps 44 are connected to both side edges of the front panel 40 through fold lines. The side flaps 42 and 44 form right and left side walls of the casing 10. Referring to FIG. 4, inner bottom flaps 46 are connected to lower ends of the inner side flaps 42 through fold lines. The inner bottom flaps 46 serve as reinforcing members of the bottom wall.

Furthermore, referring to FIG. 4, a lid panel 48 and a tongue panel 50 are connected, in the order named, to an upper edge of the rear panel 36 through the first and second self hinges 14 and 20. The lid panel 48 and the tongue panel 50 form the lid portion 18 and the tongue portion 22, respectively. A flap 52 is connected to an upper edge of the tongue panel 50 through a fold line. The flap 52 forms the striking flap 26. The above-mentioned fold lines are shown by broken lines in FIG. 4.

Prior to the folding of the blank, the mount 30 and the magnet 28 are affixed to an inner surface of the flap 52 of the blank by using the double-sided adhesive tape 32. The sheet 34 is affixed to an inner surface of the front panel 40.

The inner pack is thereafter placed on an inner surface of the rear panel 36. The flap 52 is folded along the fold line between the flap 52 and the tongue panel 50 to be laid on the inner surface of the tongue panel 50. The flap 52 is bonded to the tongue panel 50 by using the double-sided adhesive tape 32. The magnet 28 and the pedestal 30 are held between the flap 52 and the tongue panel 50.

In the next step, the panels and flaps other than the flap 52 are folded to wrap around the inner pack according to a well-known procedure. As a result, the cigarette package shown in FIG. 1 is fabricated. This cigarette package contains the inner pack.

According to the cigarette package described above, when the tongue lid 16 is in the closed position, the magnetic force of the magnet 28 of the tongue portion 22 pulls the sheet 34 of the casing 10. The tongue portion 22 overlapped with the front wall 10*f* of the casing 10 comes into a state attracted to the front wall 10*f*, and the tongue lid 16 is stably held in the closed position.

The user can easily open the tongue lid 16 by detaching the tongue portion 22 from the front wall 10*f* against the magnetic force or attracting force of the magnet 28, and then turning the tongue lid 16 about the first self hinge 14.

During the closing action of the tongue lid 16, when distance between the tongue portion 22 and the front wall 10*f* becomes a predetermined value or less, the magnet 28 of the tongue portion 22 exercises the attracting force on the sheet 34 of the front wall 10*f*. From this time point, the tongue portion 22 is applied with the attracting force to be forcedly drawn toward the front wall 10*f*. As a result, the tongue portion 22 turns about the second self hinge 20, and is overlapped with the front wall 10*f* so as to hit the front wall 10*f*. At this time, the impact between the front wall 10*f* and the tongue portion 22 makes a clap sound. This clap sound notifies the user that the tongue lid 16 is closed. By recognizing the clap sound, the user can easily verify that the tongue lid 16 is securely closed.

The magnet 28 is located near the front edge 22*a* of the tongue portion 22 and sandwiched between the tongue portion 22 and the striking flap 26, thereby weighting the tip end of the tongue portion 22. At the time of closing the tongue lid 16, that is, when the tongue portion 22 turns about the first self hinge 14, the turning moment of the tongue portion 22 is increased. Therefore, the striking flap 26 of the tongue portion 22 more hardly hits the front wall 10*f*, and thus produces a clear clap sound.

Since the sheet 34 is located near the notch 24 of the front wall 10*f*, the magnet 28 of the tongue portion 22 hits the front wall 10*f* in the vicinity of the notch 24. The front wall 10*f* thus functions as a sounding board, and the clap sound is more clearly produced.

Furthermore, when the tongue lid 16 is in the closed position, the first and second self hinges 14 and 20 of the tongue lid 16 have an arc-shaped cross-section. The closing of the tongue lid 16 is then facilitated, so that the tongue portion 22 can hit the front wall 10*f* with the entire surface of the striking flap 26 at the time of closing the tongue lid 16. This greatly contributes to the production of a clear clap sound.

The invention is not limited to the first embodiment.

Figure 5:
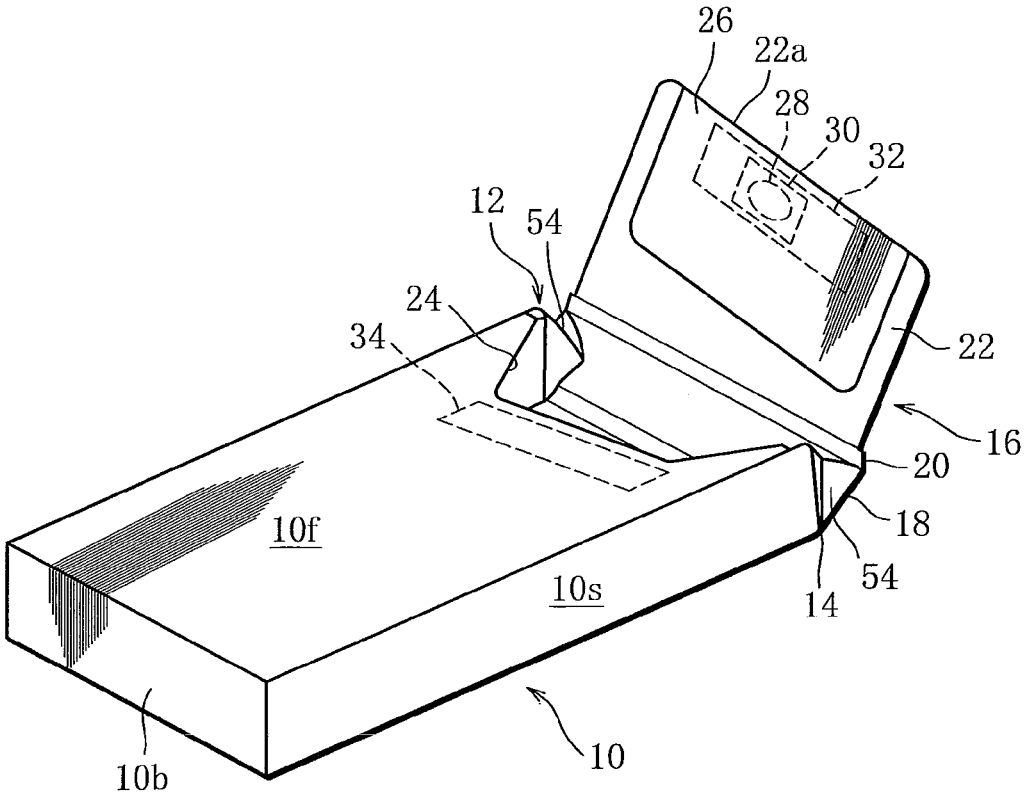
FIG. 5 is a perspective view showing a cigarette package of a second embodiment.

FIG. 5 shows a cigarette package of a second embodiment. In descriptions of the cigarette package of the second embodiment, the same reference marks are used for elements similar to those of the cigarette package of the first embodiment without adding descriptions. Only differences from the first embodiment will be described below.

Figure 6:
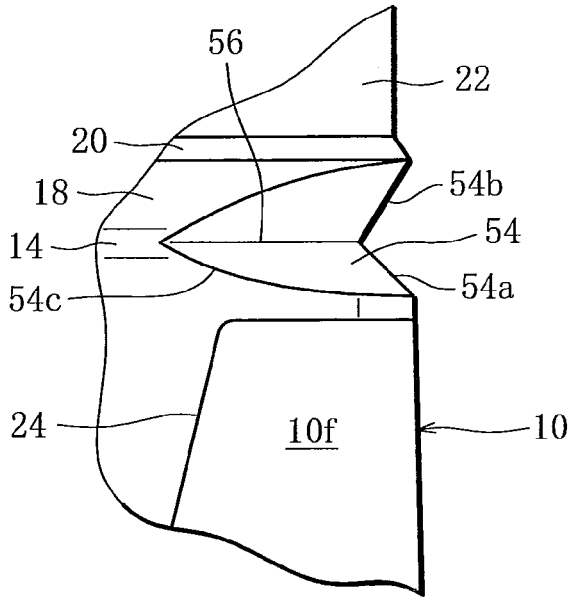
FIG. 6 shows a part of the cigarette package of FIG. 5 in an enlarged scale.

The cigarette package of the second embodiment includes a pair of foldable gussets 54 between the casing 10 and the tongue lid 16. Each of the gussets 54 is located between an upper edge of a side wall 10*s* and a corresponding side edge of the lid portion 18, and connects the upper edge and the side edge to each other. More specifically, the gusset 54 is formed in a fan-like shape, and has two linear sides 54*a* and 54*b* and one arc 54*c* as illustrated in FIG. 6. The linear side 54*a* is connected to the upper edge of the side wall 10*s* through a fold line, and the linear side 54*b* to the side edge of the lid portion 18 through a fold line. The arc 54*c* connects one ends of the linear side 54*a* to each other. The other ends of the linear sides 54*a* and 54*b* form the center of the fan-shaped gusset 54. The gusset 54 has a fold line 56 extending from the center thereof to the midpoint of the arc 54*c*. The fold line 56 divides the gusset 54 into two equal parts.

As is apparent from FIGS. 5 and 6, at the time of closing the tongue lid 16, the gussets 54 are folded along the fold lines 56 toward the open end 12 of the casing 10. When the tongue lid 16 is in the closed position, therefore, each of the gussets 54 is sandwiched between the open end 12 of the casing 10 and the lid portion 18 while being folded in half.

When the tongue lid 16 is opened, the gusset 54 is restored from the folded position to the original fan-like shape, and forms a partition wall blocking a gape between the upper edge of the side wall 10*s* and the side edge of the lid portion 18. The gussets 54 therefore not only increase mechanical strength of the open end 12 but also eliminate the gapes between the lid 16 and the side walls 10*s*. The gussets 54 thus surely prevent shred tobacco, which has leaked out of the filter cigarette into the casing 10, from being spilled out of the casing 10 through the open end 12.

Figure 7:
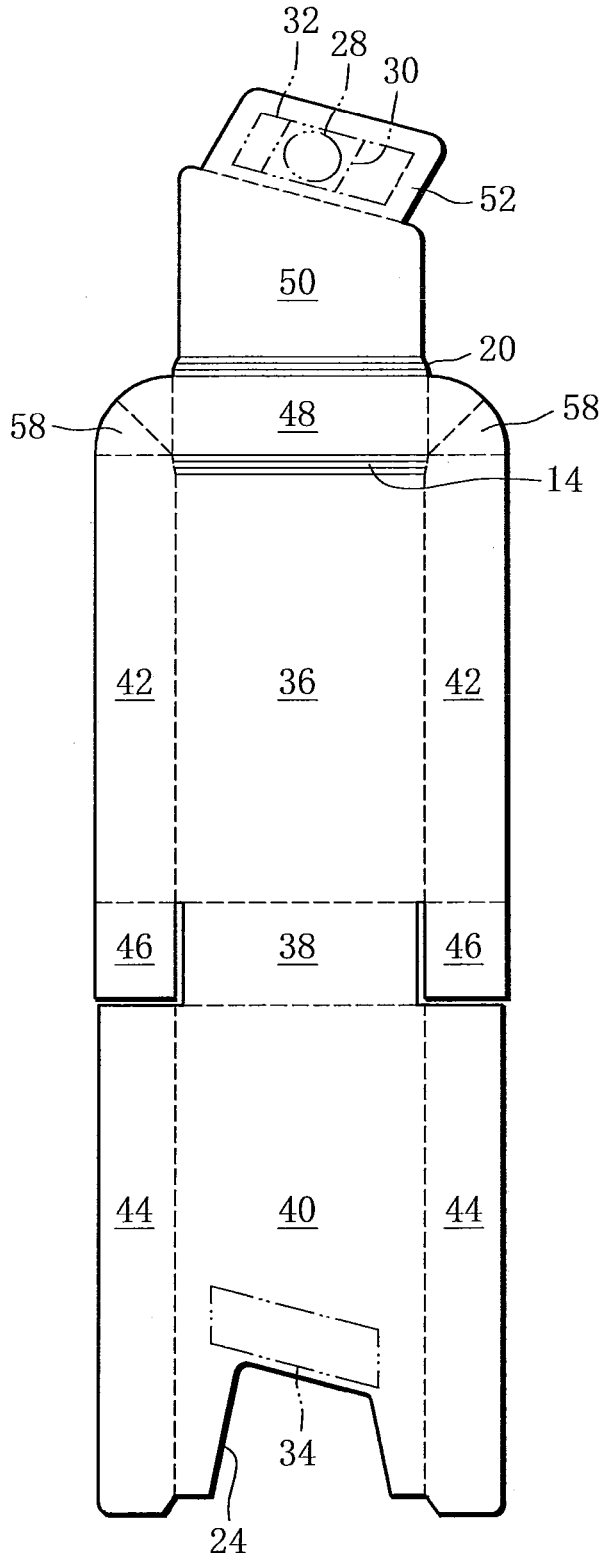
FIG. 7 shows a blank for fabricating the cigarette package of FIG. 5.

FIG. 7 shows a blank for fabricating the cigarette package illustrated in FIG. 5. This blank further includes fan-shaped flaps 58 connecting the inner side flaps 42 to the lid panel 48 through fold lines. Each of the fan-shaped flaps 58 has a fold line 56 in the center thereof, and forms the foldable gusset 54.

Unlike the first and second embodiments, the magnet 28 may be disposed in the inner surface of the front wall 10*f*, and the sheet 34 may be disposed in the tongue 22.

The invention claimed is:

1. A cigarette package comprising:

a casing with an open end;

a tongue lid connected to a rear edge of the open end of said casing through a first self hinge, said tongue lid including a lid portion for opening/closing the open end, and a tongue portion connected to a tip end of the lid portion through a second self hinge and overlapped with a front wall of said casing when said tongue lid is in a closed position, the tongue portion having two free side edges; and a sound-producing/holding device for making a clap sound indicating that said tongue lid is brought into the closed position at the time of closing said tongue lid, and holding said tongue lid in the closed position, said sound-producing/holding device including a magnet fixed onto an inner surface of either one of the front wall and the tongue portion, and a sheet member fixed onto an inner surface of the other of the front wall and the tongue portion, wherein when said lid is moved to a closed position and one of the magnet and the sheet member strikes the other of the magnet and the sheet member through the front wall, the magnet and the sheet member make the clap sound and keep the front wall sandwiched therebetween by being attracted to each other with the magnet being fixed onto an inner surface of a tip end portion of the tongue portion, and the sheet member is fixed onto the inner surface of the front wall and said magnet increases a weight of the tip end portion of the tongue portion so as to increase turning moment of the tongue portion when the tongue lid is moved toward the closed position with the tongue portion turned about the second self hinge, wherein said sound-producing/holding device further includes a striking flap fixed onto an inner surface of the tongue portion, the striking flap covering the magnet, wherein the striking flap extends integrally from the tip end of the tongue portion, wherein said sound producing/holding device further includes a sheetlike mount arranged between the magnet and the tongue portion and a double sided adhesive tape covering the magnet and the mount, the adhesive tape sticking to both an inner surface of the striking flap and the inner surface of the tongue portion.

2. The cigarette package according to claim 1, wherein said sound-producing/holding device further includes a notch formed in a front edge of the open end; and when said tongue lid is in the closed position, the notch is covered with the tongue portion.

3. The cigarette package according to claim 2, wherein the sheet member is located near the notch.

4. The cigarette package according to claim 2, wherein the tongue portion has a distal edge inclined in relation to the lid portion and the notch has a deformed U-shape adapted to the inclination of the distal edge of the tongue portion.

5. The cigarette package according to claim 1, wherein the first and second self hinges have an arc-shaped cross-section when said tongue lid is in the closed position.

6. The cigarette package according to claim 1, further including a foldable gusset connecting a side edge of the lid portion and a side wall of said casing to each other.

7. The cigarette package according to claim 1, wherein the second self hinge is formed of a group of fold lines extending parallel to one another along a width direction of said tongue lid.

8. The cigarette package according to claim 7, wherein the first self hinge is formed of a group of fold lines extending parallel to one another along the width direction of said tongue lid.

9. A cigarette package comprising:

a casing with an open end;

a tongue lid operatively connected to a rear edge of the open end of said casing through a first self hinge, said tongue lid including a lid portion for opening/closing the open end, and a tongue portion connected to a tip end the lid portion through a second self hinge and extending downwardly to overlap with a front wall of said casing when said tongue lid is in a closed position, the tongue portion having two free side edges; and a sound-producing/holding device for making a clap sound indicating that said tongue lid is brought into the closed position at the time of closing said tongue lid, and holding said tongue lid in the closed position, said sound-producing/holding device including a magnet fixed onto an inner surface of one of the front wall and the tongue portion, and a sheet member fixed onto an inner surface of one of the tongue portion and the front wall, wherein when said lid is moved to a closed position and one of the magnet and the sheet member strikes one of the sheet member and the magnet through the front wall, the magnet and the sheet member make the clap sound and are attracted to each other to maintain the front wall sandwiched therebetween with the magnet being fixed onto an inner surface of a tip end portion of the tongue portion, and the sheet member is fixed onto the inner surface of the front wall and said magnet increases a weight of the tip end portion of the tongue portion so as to increase turning moment of the tongue portion when the tongue lid is moved toward the closed position with the tongue portion turned about the second self hinge, wherein said sound-producing/holding device further includes a striking flap fixed onto an inner surface of the tongue portion, the striking flap covering the magnet, wherein the striking flap extends integrally from the tip end of the tongue portion, wherein said sound producing/holding device further includes a sheetlike mount arranged between the magnet and the tongue portion and a double sided adhesive tape covering the magnet and the mount, the adhesive tape sticking to both an inner surface of the striking flap and the inner surface of the tongue portion.

10. The cigarette package according to claim 9, wherein said sound-producing/holding device further includes a notch formed in a front edge of the open end; and when said tongue lid is in the closed position, the notch is covered with the tongue portion.

11. The cigarette package according to claim 10, wherein the sheet member is located near the notch.

12. The cigarette package according to claim 10, wherein the tongue portion has a distal edge inclined in relation to the lid portion and the notch has a deformed U-shape adapted to the inclination of the distal edge of the tongue portion.

13. The cigarette package according to claim 9, wherein the first and second self hinges have an arc-shaped cross-section when said tongue lid is in the closed position.

14. The cigarette package according to claim 9, further including a foldable gusset connecting a side edge of the lid portion and a side wall of said casing to each other.

15. The cigarette package according to claim 9, wherein the second self hinge is formed of a group of fold lines extending parallel to one another along a width direction of said tongue lid.

16. The cigarette package according to claim 15, wherein the first self hinge is formed of a group of fold lines extending parallel to one another along the width direction of said tongue lid.

* * * * *